US006092986A

United States Patent [19]

Oeynhausen et al.

[11] Patent Number: 6,092,986

[45] Date of Patent: Jul. 25, 2000

[54] TURBINE PLANT HAVING A THRUST ELEMENT, AND THRUST ELEMENT

[75] Inventors: Heinrich Oeynhausen; Axel Remberg, both of Mülheim, Germany

[73] Assignee: Siemens Aktiengesellschaft, Munich, Germany

[21] Appl. No.: 09/237,173

[22] Filed: Jan. 25, 1999

Related U.S. Application Data

[63] Continuation of application No. PCT/DE97/01546, Jul. 22, 1997.

[30] Foreign Application Priority Data

Jul. 24, 1996 [DE] Germany ..... 196 29 933

[51] Int. Cl.[7] ..... F01D 25/24

[52] U.S. Cl. ..... 415/134; 415/135; 415/104; 415/213.1; 415/214.1

[58] Field of Search ..... 415/135, 134, 415/213.1, 214.1, 108, 104

[56] References Cited

U.S. PATENT DOCUMENTS

| | | | |
|---|---|---|---|
| 3,771,489 | 11/1973 | Marroni, Jr. et al. | 122/510 |
| 4,744,726 | 5/1988 | Remberg | 415/213.1 |
| 5,051,061 | 9/1991 | Meylan | 415/104 |
| 5,330,320 | 7/1994 | Mansson | 415/131 |

FOREIGN PATENT DOCUMENTS

| | | |
|---|---|---|
| 0 374 645 A1 | 6/1990 | European Pat. Off. . |
| 1 216 322 | 5/1966 | Germany . |
| 35 22 916 A1 | 1/1987 | Germany . |
| 1 145 612 | 3/1969 | United Kingdom . |

OTHER PUBLICATIONS

International Patent Application No. WO 95/30078 (Laffont), dated Nov. 9, 1995.

*Primary Examiner*—Edward K. Look
*Assistant Examiner*—Richard Woo
*Attorney, Agent, or Firm*—Herbert L. Lerner; Laurence A. Greenberg; Werner H. Stemer

[57] ABSTRACT

A turbine plant, in particular a steam-turbine plant, includes at least two turbine sections, each having a turbine rotor extending along a main axis and an inner casing accommodating guide blades. At least one inner casing is displaceable in axial direction and a thermally expanding thrust element is provided for an axial displacement. The trust element has first and second expansion components connected to one another by a coupling component. The coupling component mechanically and/or hydraulically produces an axial displacement of the second expansion component which is greater than a thermal expansion and/or axial displacement of the first expansion component. A thrust element for reducing different axial expansions between two components expandable independently of one another along a main axis, is also provided.

8 Claims, 3 Drawing Sheets

TURBINE PLANT HAVING A THRUST ELEMENT, AND THRUST ELEMENT

CROSS-REFERENCE TO RELATED APPLICATION

This application is a continuation of copending International application No. PCT/DE97/01546, filed Jul. 22, 1997, which designated the United States.

BACKGROUND OF THE INVENTION

Field Of The Invention

The invention relates to a turbine plant, in particular a steam-turbine plant, including at least two turbine sections, each having a turbine rotor extending along a main axis. The turbine rotors are rigidly connected to one another. Each turbine section has an inner casing accommodating guide blades. At least one of the inner casings is displaceable in axial direction. A thermally expanding thrust element is provided for an axial displacement of the inner casing. The invention also relates to a thrust element per se.

German Published, Non-Prosecuted Patent Application DE 35 22 916 A1 describes a turbo set having at least one low-pressure turbine section, which has an outer casing and an inner casing coaxial thereto, and at least one high-pressure and/or intermediate-pressure turbine section disposed coaxially to and upstream of the low-pressure turbine section. Shafts of the turbine sections are rigidly coupled to one another to form a line of shafting. An axial bearing for the line of shafting is mounted upstream of the low-pressure turbine section. The axial bearing defines a reference plane from which the axial shaft expansion and displacement start. The inner casing is attached to an axially movably mounted end of an axially adjacent turbine-section casing or to a turbine-bearing housing through the use of thrust-transmitting coupling rods. The coupling rods are led out in a thermally movable and vacuum-tight manner through a wall of the outer casing, through the use of sealing elements, which also permit a limited transverse movement. A turbine bearing mounted upstream of the low-pressure turbine section defines a second reference plane from which the axial expansion and displacement of the turbine-section casing supported on the turbine bearing and of the turbine-section casing coupled thereto start.

In that way, an axial displacement of the line of shafting and of the turbine-section casings is effected over virtually the same axial expansion and in the same direction, in the course of which only minimum axial clearances occur between moving-blade and guide-blade rings adjacent one another. The thrust transmission through the use of the coupling rods is placed in the region of thrust-transmitting turbine bearings. In addition, a vacuum-tight leadthrough of the coupling rods is structurally combined with a horizontally thermally movable claw mounting of the inner casing of the low-pressure turbine section. Claw arms of the inner casing extend in a direction parallel to the shaft axis and rest with slidable supporting and guide surfaces on the supports of the associated bearing housing. The coupling rods are frictionally coupled to the claw arms in the region of the turbine bearings. In particular, a diaphragm seal for a vacuum-tight leadthrough is attached in a vacuum-tight manner with an outer annular flange to an end surface of the outer casing of the low-pressure turbine section and with an inner annular flange to a turbine-bearing housing part. The configuration of the sealing elements between seating surfaces on the outer-casing end wall and on the bearing housing, that is between parts of only slight relative displacement, causes the larger thermal displacements of the inner casings to be uncoupled from the sealing elements.

German Published, Prosecuted Patent Application DE-AS 1 216 322 describes a steam or gas turbine having a plurality of turbine sections disposed coaxially one behind the other. The shafts thereof are rigidly coupled to one another and of the casings thereof at least one is axially displaceable and is coupled to a fixed turbine-section casing or bearing block. The low-pressure casings of the turbine are each formed of an outer and an inner casing. The inner casing of the low-pressure turbine is coupled to an adjacent turbine-section casing or a bearing block by a linkage which is led through the wall of the outer casing in a steam-tight and thermally movable manner. The linkage may be a single rod which is sealed off in the outer-casing wall by axially and radially flexible bellows. Furthermore, the linkage may be formed of three axially aligned rods connected to one another in an articulated manner, the center rod of which is axially movable with a sliding fit in a bush of the outer-casing wall. Such a linkage is intended to effect an axial displacement of the casings, through the use of which the axial clearance between the rotor and the casings is kept as constant as possible. In order to change the size of the axial clearance, a change in the length of the casing is possible by changing its temperature. That change in the temperature is carried out by an additional thermal load on the linkage through the use of steam or a liquid.

Such a change in the size of the axial clearance, during which hot steam is passed through a pipe, is described in UK Patent GB 1,145,612. An axially expandable pipe is connected at each of its end surfaces to a rod, which in turn is fastened in each case to the inner casing of a low-pressure turbine section. An axial displacement of the inner casings relative to a turbine rotor is composed of the respective expansion of the inner casings, the expansion of the coupling rods and the expansion of the expansion pipes. The thermal expansion of the inner casings that are coupled to one another is defined starting from a fixed point which is disposed at the outer casing of the low-pressure turbine section lying furthest upstream. This starting point of the thermal expansions of the inner casings differs from the starting point of the thermal expansions of the rotor, which is defined in a bearing lying further upstream. The expansion pipes are connected through respective compensators to the corresponding outer casings of the low-pressure turbine sections, so that the absolute expansion of the system of inner casings and coupling rods has to be absorbed by the compensators. In order to ensure a large degree of constancy between the expansion of the turbine rotor and the system of inner casings and coupling rods, steam is to be fed to the expansion pipes in a predetermined manner. The steam must either be extracted from the steam process or be provided separately. A control and monitoring system is also required, through the use of which the steam required in order to compensate for the axial clearance is directed to the expansion pipes, depending on the operating state of the steam turbines.

SUMMARY OF THE INVENTION

It is accordingly an object of the invention to provide a turbine plant having a thrust element in which an axial clearance between a rotor and an inner casing remains below a predeterminable value in a simple manner, in particular without complicated control and monitoring systems, and a corresponding thrust element for reducing the axial clearance between the turbine rotor and the inner casing of the turbine plant, which overcome the hereinafore-mentioned disadvantages of the heretofore-known devices of this general type.

With the foregoing and other objects in view there is provided, in accordance with the invention, a turbine plant, in particular a steam-turbine plant, comprising at least two turbine sections each having: guide blades; an inner casing accommodating the guide blades, at least one of the inner casings displaceable in axial direction; a turbine rotor extending along a main axis, the turbine rotors rigidly connected to one another; and a thermally expanding thrust element on the inner casing for axial displacement of the inner casing, the thrust element having first and second expansion components, and a coupling component connecting the expansion components to one another, the coupling component producing at least one of mechanical and hydraulic axial displacement of the second expansion component greater than at least one of thermal expansion and axial displacement of the first expansion component.

In accordance with another feature of the invention, the coupling element is a mechanical lever. This lever is rotatable about a fixed point and the first expansion component and the second expansion component are likewise rotatably connected to the lever at a respective connecting point. The distance of the second connecting point from the fixed point is greater than the distance of the first connecting point from the fixed point. A displacement of the first connecting point caused by a thermal expansion and/or a displacement of the first expansion component therefore produces a rotation of the mechanical lever about its fixed point. Since the lever arm of the second expansion component, i.e. the distance between the second connecting point and the fixed point, is greater than the lever arm of the first expansion component, the mechanical lever produces an axial displacement of the second expansion component which acts in the same direction as, and is greater than, the axial displacement of the first connecting point.

In this way, in particular in the case of a configuration of three low-pressure turbine sections which are used for high output at low cooling-water temperatures in a steam-turbine plant, the expansion of the third low-pressure inner casing relative to the turbine rotor is kept so small that the axial clearance between the stationary guide blades and the rotating moving blades remains under a predeterminable value, even at full load of the steam-turbine plant. The axial clearance can be set to a value which essentially corresponds to the axial clearance of the other low-pressure turbine sections, by the selection of appropriate lever arms acting in the same direction. All low-pressure turbine sections may therefore be of identical construction.

It is of course possible for all low-pressure turbine sections disposed one after the other in axial direction to be connected through a thrust element with the simple articulation mechanism described. Axial movements can be produced for each of the low-pressure turbine sections by a suitable selection of the lever arms and thus a corresponding transmission ratio. The axial movements reduce the expansion relative to the turbine rotor by a predeterminable value. In particular, the relative expansions can be set to be constant in each case. It is likewise possible to connect individual low-pressure turbine sections to one another through rigid thrust elements without a mechanical or hydraulic displacement amplifier.

A coupling component which mechanically and/or hydraulically produces an amplification of the axial displacement and/or axial expansion of the first expansion component in the same direction is simple to realize in terms of construction and requires no complicated monitoring and control equipment and no feeding of steam through additional lines. With such a coupling component, a reduction in the axial clearance between guide blades and moving blades of a turbine plant is therefore achieved at little cost in terms of construction and operation, as a result of which the efficiency of the turbine plant can be increased.

In accordance with a further feature of the invention, the thrust element is led together with a support of a bearing carrying the inner casing through a seal of an outer casing surrounding the inner casing. The seal preferably has sealing bellows extendable in axial direction. The common leadthrough gives rise to a reduction in the leadthroughs of the outer casing and thus to a simplification of the construction.

In accordance with an added feature of the invention, there is provided an axial expansion combination, including the thrust element with the displacement amplifier (lever), an inner casing or a plurality of inner casings and if need be thrust elements without a displacement amplifier (coupling rods), with the turbine rotors connected to one another preferably having a common axial datum point. In an expansion combination being formed of an outer casing of an intermediate-pressure turbine section and inner casings of two or more low-pressure turbine sections, this axial datum point is preferably a turbine bearing which is disposed in the axial direction in front of all of the turbine sections and serves to mount the outer casing of the intermediate-pressure turbine section.

With the objects of the invention in view, there is also provided a thrust element for reducing different axial expansions or clearances between two components expandable independently of one another along a main axis, in particular turbine rotors and inner casings of a turbine plant, the thrust element comprising first and second expansion components; a coupling element in the form of a mechanical lever rotatable about a fixed point; the first and second expansion components rotatably connected to the mechanical lever at respective first and second connecting points; and the second connecting point disposed further away from the fixed point than the first connecting point.

A displacement amplification of the second connecting point is thereby produced as a result of the lever action when the first connecting point is displaced. The second connecting point is therefore displaced further in axial direction than the first connecting point. The thrust element may also have a hydraulic displacement amplifier which is formed, for example, by a hydraulic passage narrowing along the main axis. The first expansion component and the second expansion component in each case adjoin the ends of the hydraulic passage. A displacement of the first expansion component in the direction of the narrowing of the hydraulic passage causes an incompressible hydraulic fluid disposed therein to be displaced into the narrowing part. Due to the constant volume, the hydraulic fluid therefore penetrates into the narrowing part further than the displacement of the hydraulic fluid by the first expansion component. A displacement amplification is thereby produced by the incompressible hydraulic fluid.

Other features which are considered as characteristic for the invention are set forth in the appended claims.

Although the invention is illustrated and described herein as embodied in a turbine plant having a thrust element, and a thrust element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
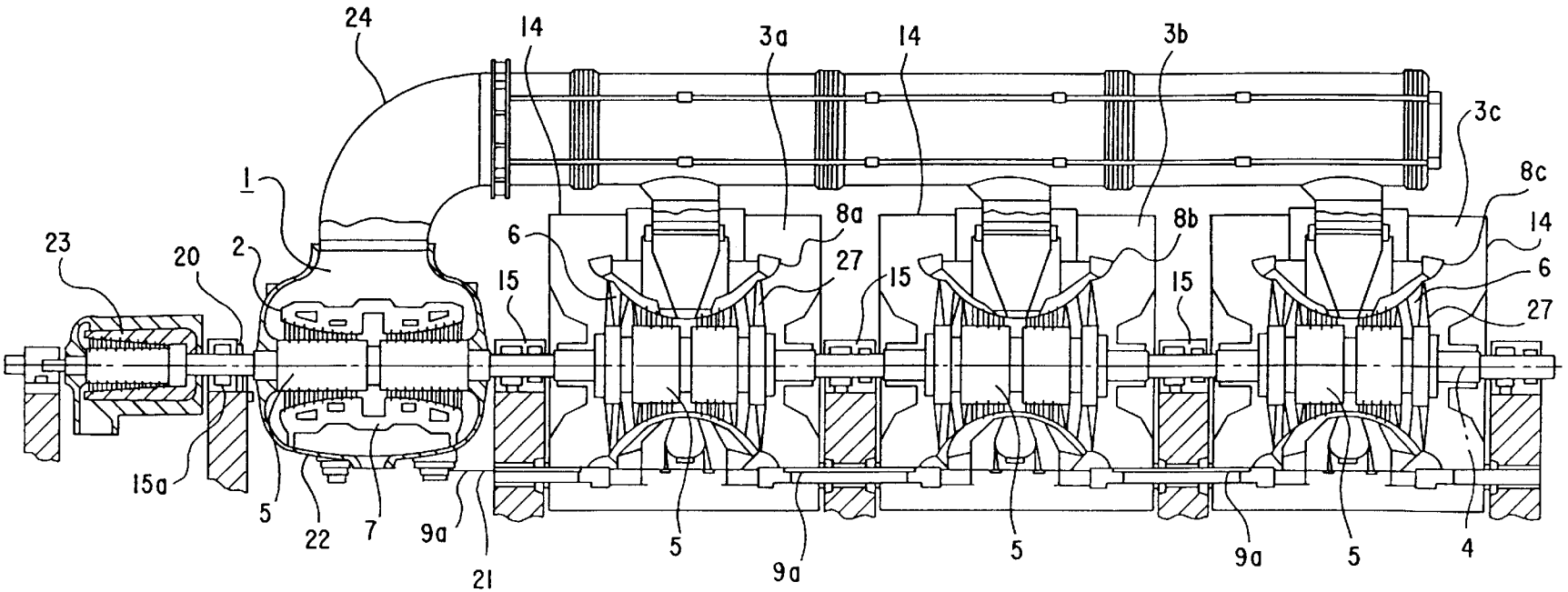
FIG. 1 is a fragmentary, diagrammatic, longitudinal-sectional view through a steam-turbine plant and an associated graph of a thermal expansion plotted against a location along a main axis of the steam-turbine plant.

Referring now to the figures of the drawings in detail and first, particularly, to FIG. 1 thereof, there is seen a steam-turbine plant 1 having a high-pressure turbine section 23, an intermediate-pressure turbine section 2 and three low-pressure turbine sections 3*a*, 3*b*, 3*c* with essentially the same construction. The turbine sections are disposed one behind the other along a main axis 4. The low-pressure turbine sections 3*a*, 3*b*, 3*c* are fluidically connected to the intermediate-pressure turbine section 2 by a steam feed 24. The intermediate-pressure turbine section 2 has an outer casing 22. Each low-pressure turbine section 3*a*, 3*b*, 3*c* has a respective inner casing 8*a*, 8*b*, 8*c* and an outer casing 14 surrounding the inner casing 8*a*, 8*b*, 8*c*. Each inner casing 8*a*, 8*b*, 8*c* carries guide blades 6 for the admission of low-pressure steam. A respective turbine rotor 5 which is disposed in each inner casing 8*a*, 8*b*, 8*c* extends along the main axis 4 and carries low-pressure moving blades 27. The intermediate-pressure turbine section 2 has an inner casing 7. A bearing 15 is disposed between the intermediate-pressure turbine section 2 and the first low-pressure turbine section 3*a* and respective bearings 15 are disposed between the adjacent low-pressure turbine sections 3*a*, 3*b*, 3*c*. These bearings 15 serve to mount both the turbine rotors 5 and the respective inner casings 8*a*, 8*b*, 8*c*. A bearing 15*a* for mounting the turbine rotors of these turbine sections 2, 23 is likewise provided between the high-pressure turbine section 23 and the intermediate-pressure turbine section 2. A coupling rod 9*a* is run in each case parallel to the main axis 4 in the region in which the inner casings 8*a*, 8*b*, 8*c* are mounted on the respective bearings 15. One of the coupling rods 9*a* connects the intermediate-pressure turbine section 2 to the first low-pressure turbine section 3*a* and respective coupling rods 9*a* connect the mutually adjacent inner casings 8*a*, 8*b*, 8*c* of the low-pressure turbine sections 3*a*, 3*b*, 3*c* to one another. The outer casing 22 is connected through a thrust connection 21 to the inner casing 8*a* of the low-pressure steam-turbine section 3*a*.

The outer casing 22, the inner casings 8*a*, 8*b*, 8*c* as well as the coupling rods 9*a* and the thrust connection 21 connecting the casings, form an expansion combination which expands axially in the direction of the main axis 4 when hot steam is admitted. This expansion combination which is thus formed has a fixed or datum point 20, which is located at the bearing 15*a* between the high-pressure turbine section 23 and the intermediate-pressure turbine section 2. The size of the thermal expansion calculated from this datum point 20 along the main axis 4 is shown by an expansion line 25. A corresponding expansion line 26 of the mutually rigidly connected turbine rotors 5 of the intermediate-pressure turbine section 2 and the low-pressure turbine sections 3*a*, 3*b*, 3*c*, is likewise shown. Due to the connection of the low-pressure turbine sections 3*a*, 3*b*, 3*c* to form an expansion combination, in combination with the outer casing 22 of the intermediate-pressure turbine section 2, the individual thermal expansions are utilized in order to displace the inner casings 8*a*, 8*b*, 8*c* along the main axis 4 in the direction of a non-illustrated generator. All of the thermal expansions of the inner casings 8*a*, 8*b*, 8*c* are therefore added up along the main axis 4, as a result of which the expansion relative to the mutually rigidly connected turbine rotors 5 is reduced. A comparison between the expansion lines 25 and 26 shows that there is nonetheless a difference in expansion between the turbine rotors 5 and the inner casing 8*c* of the last low-pressure turbine section 3*c* over the entire length of the turbine plant 1. This difference in expansion produces a different axial clearance between the guide blades 6 and the moving blades 27 of each low-pressure turbine section 3*a*, 3*b*, 3*c*.

Figure 2:
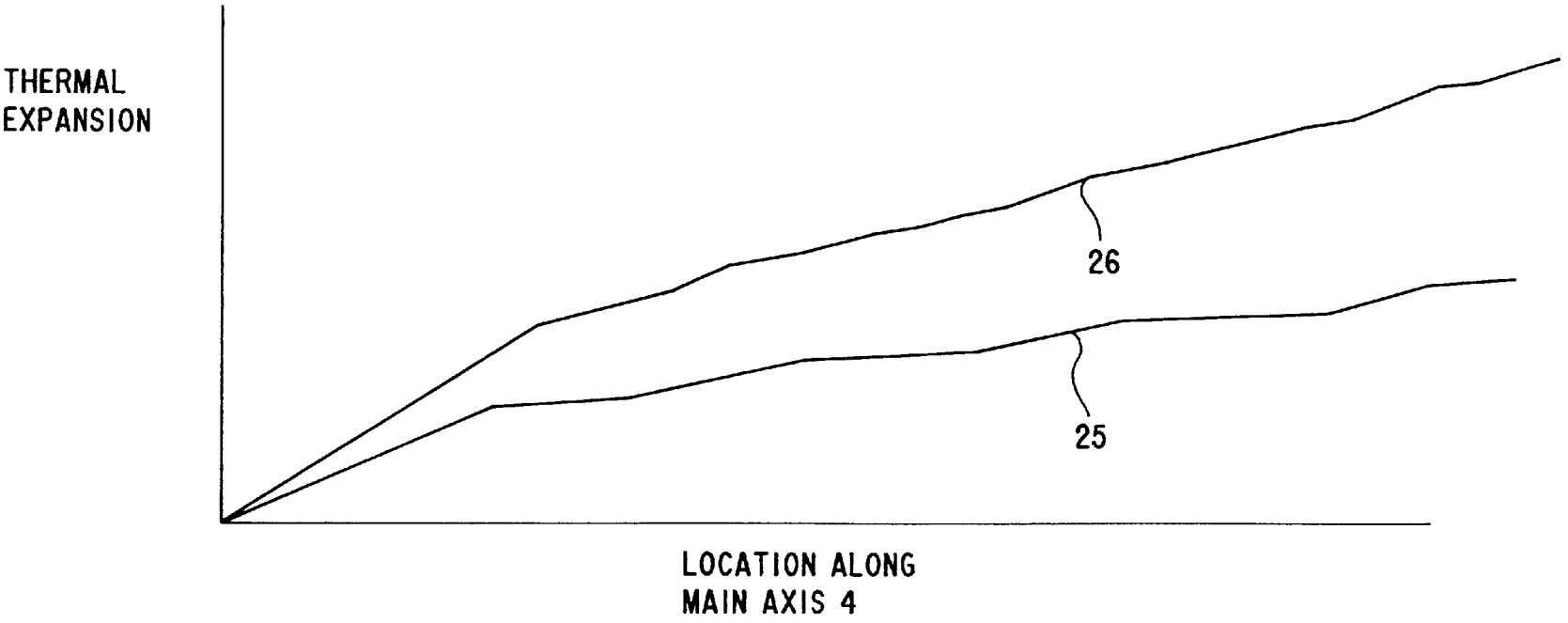
FIG. 2 is an enlarged, fragmentary, longitudinal-sectional view through a bearing between two low-pressure turbine sections having a thrust element.
Figure 3:
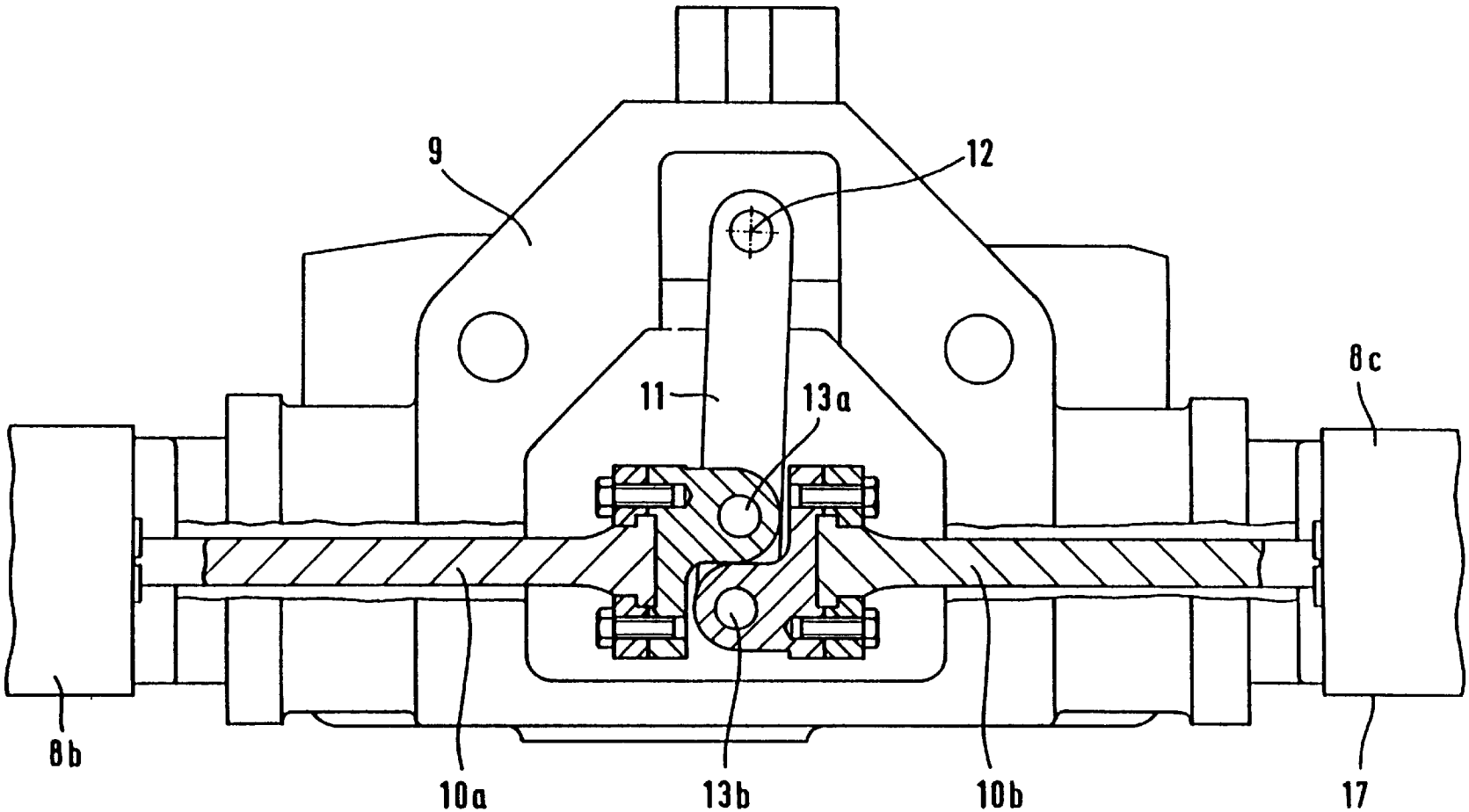
FIG. 3 is a fragmentary, plan view of the thrust element according to FIG. 2.

Such a difference in expansion can be markedly reduced by a predeterminable value through the use of a thrust element 9 shown in more detail in FIGS. 2 and 3, with an amplification of the displacement of an inner casing 8*a*, 8*b*, 8*c* of a low-pressure turbine section 3*a*, 3*b*, 3*c*. Such a thrust element 9 an be disposed as a replacement for a coupling rod 9*a* between the intermediate-pressure turbine section 2 and the first low-pressure turbine section 3*a* as well as between respectively adjacent low-pressure turbine sections 3*a*, 3*b*, 3*c*. The thrust element 9 is preferably disposed between the last two low-pressure turbine sections 8*b*, 8*c*. The thrust element 9 has an essentially rod-shaped first expansion component 10*a* and a likewise essentially rod-shaped second expansion component 10*b*. These expansion components 10*a*, 10*b* are connected to one another in an articulated manner through a coupling component 11.

As can be seen from FIG. 3, the coupling component 11 is a mechanical lever which is rotatable about a fixed point 12. Each of the expansion components 10*a*, 10*b* is rotatably connected by non-illustrated pins to the coupling component 11 at a respective connecting point 13*a*, 13*b* in such a way as to be displaceable in the direction of the main axis 4. The connecting point 13*a* is closer to the fixed point 12 than the connecting point 13*b*. In this configuration, the connecting point 13*a* lies between the connecting point 13*b* and the fixed point 12 so that a displacement of the connecting point 13*a* in the direction of the main axis 4 produces a larger displacement of the connecting point 13*b* in the direction of the main axis 4. The expansion components 10*a*, 10*b* pass through a respective bearing 15 and are led together with a respective support region 28*a*, 28*b* through the respective outer casing 14 of the corresponding low-pressure turbine section 3*b*, 3*c*. This leadthrough is effected in a gastight manner through the use of a respective seal 16. The seal 16 has sealing bellows 18 extendable in the direction of the main axis 4. The inner casing 8*b*, into which the expansion component 10*a* is firmly screwed, rests on the support 28*a*. The inner casing 8*c* accordingly rests on the support 28*b*, and the expansion component 10*b* is firmly screwed into a corresponding supporting claw 17 of this inner casing 8*c*.

A corresponding displacement amplification by a predeterminable value can be set by the coupling component 11 depending on the position of the connecting points 13*a*, 13*b* relative to the fixed point 12. The coupling component 11 therefore provides a displacement amplification, in a manner which is simple in terms of construction and is largely free of maintenance, without a complicated control, monitoring and line system, as would be necessary in the case of a displacement amplification through the use of a temperature increase caused by steam.

The invention is distinguished by a thrust element in a turbine plant having a plurality of turbine sections, in which a displacement amplification is achieved in a mechanical and/or hydraulic manner through the use of the thrust element. The thrust element preferably has a coupling component which constitutes a mechanical lever, to which two thrust rods having different lever arms, but which lie on the same side with regard to a fixed point, are attached in an articulated manner. An amplification of the displacement of an inner casing of a turbine section, which amplification is produced in axial direction, permits a reduction in the axial clearance between the moving blades of a turbine rotor and the guide blades of the inner casing. In addition to the use of inner casings having essentially the same construction, this also results in an increase in the efficiency of the entire turbine plant. The turbine plant is preferably a steam-turbine plant having a high-pressure turbine section, an intermediate-pressure turbine section and two or more, in particular three, low-pressure turbine sections. Such a thrust element is of course also suitable for reducing the axial clearance in a gas-turbine plant having a plurality of turbine sections.

We claim:

1. A turbine plant, comprising at least two turbine sections each having:

guide blades;

an inner casing accommodating said guide blades, at least one of said inner casings displaceable in axial direction;

a turbine rotor extending along a main axis, said turbine rotors rigidly connected to one another; and a thermally expanding thrust element for axial displacement of said inner casing, said thrust element having first and second expansion components, and a coupling component connecting said expansion components to one another, said coupling component producing at least one of mechanical and hydraulic axial displacement of said second expansion component greater than at least one of thermal expansion and axial displacement of said first expansion component.

2. The turbine plant according to claim 1, wherein said coupling element is a mechanical lever rotatable about a fixed point, said first and second expansion components are rotatably connected to said lever at respective connecting points, and said second connecting point is further away from said fixed point than said first connecting point.

3. The turbine plant according to claim 1, wherein at least one of said turbine sections connected to said thrust element has an outer casing surrounding said inner casing, a seal, a bearing carrying said inner casing, and a support for said bearing, said thrust element and said support led together through said seal.

4. The turbine plant according to claim 1, including an axial expansion combination containing said thrust element, said axial expansion combination and said mutually connected turbine rotors having a common axial datum point.

5. The turbine plant according to claim 1, wherein said at least two turbine sections include an intermediate-pressure steam-turbine section and at least two low-pressure steam-turbine sections disposed along said main axis, and said inner casings of said low-pressure steam-turbine sections are connected to said thrust element.

6. The turbine plant according to claim 5, including:

an axial expansion combination containing said thrust element, said axial expansion combination and said mutually connected turbine rotors having a common axial datum point;

said intermediate-pressure steam-turbine section having an outer casing;

a thrust connection connecting said outer casing to said inner casing of said low-pressure steam-turbine section disposed downstream in axial direction; and a bearing connected to said outer casing and forming said axial datum point for axial thermal expansion.

7. A thrust element for reducing different axial expansions between two components expandable independently of one another along a main axis, the thrust element, comprising:

first and second expansion components;

a coupling element in the form of a mechanical lever rotatable about a fixed point;

said first and second expansion components rotatably connected to said mechanical lever at respective first and second connecting points for reducing axial expansions; and said second connecting point disposed further away from said fixed point than said first connecting point.

8. A thrust element for reducing different axial expansions between turbine rotors and inner casings of a turbine plant expandable independently of one another along a main axis, the thrust element comprising:

first and second expansion components;

a coupling element in the form of a mechanical lever rotatable about a fixed point;

said first and second expansion components rotatably connected to said mechanical lever at respective first and second connecting points; and said second connecting point disposed further away from said fixed point than said first connecting point.

* * * * *